United States Patent [19]

Andersen

[11] Patent Number: 4,745,584

[45] Date of Patent: May 17, 1988

[54] SONAR TRANSDUCER ARRAY

[75] Inventor: James K. Andersen, Arnold, Md.

[73] Assignee: Westinghouse Electric Corp., Pittsburgh, Pa.

[21] Appl. No.: 912,856

[22] Filed: Sep. 29, 1986

[51] Int. Cl.[4] ..... H04R 00/00

[52] U.S. Cl. ..... 367/153; 367/173; 29/594; 29/841; 381/205; 248/544; 248/223.4

[58] Field of Search ..... 367/1, 150, 152, 153–156, 367/165, 173, 191, 188; 181/0.5, 140; 248/544, 27.1, 223.4; 310/337, 335, 348, 350, 354; 179/110 A; 403/331, 377; 361/415, 417, 420; 264/272.15; 29/594, 841; 381/205

[56] References Cited

U.S. PATENT DOCUMENTS

| | | | |
|---|---|---|---|
| 2,947,969 | 8/1960 | Harris | 367/173 |
| 3,197,731 | 7/1965 | Beale et al. | 361/415 X |
| 3,256,479 | 6/1966 | Edwards | 367/14 X |
| 3,492,633 | 1/1970 | Massa | 367/173 |
| 3,928,894 | 12/1975 | Bury et al. | 248/223.4 X |
| 4,158,189 | 6/1979 | Wardle | 367/153 |
| 4,399,526 | 8/1983 | Eynck | 367/173 X |
| 4,454,566 | 6/1984 | Coyne | 361/415 X |
| 4,545,041 | 10/1985 | Tims et al. | 367/155 X |
| 4,631,711 | 12/1986 | Fowler | 181/112 X |

*Primary Examiner*—Deborah L. Kyle
*Assistant Examiner*—Brian S. Steinberger
*Attorney, Agent, or Firm*—D. Schron

[57] ABSTRACT

A transducer array which includes backing and an acoustic window separated by a plurality of elongated parallel rail members having notches in the sidewalls thereof. Notches in adjacent rail members accommodate a stave member which carries a plurality of transducer elements. A stave member may be placed in the notch and slid into position from which it may be easily removed by reversing the process. The design is such that when used with a fairing to provide hydrodynamic shape, the assembly may be free-flooded with the surrounding water medium. In situ replacement of a transducer element may be accomplished by removal of a small section of the fairing and the subsequent removal of one or more stave members.

18 Claims, 6 Drawing Sheets

SONAR TRANSDUCER ARRAY

BACKGROUND OF THE INVENTION

1. Field of the Invention:

The invention in general relates to sonar transducer arrays, and particularly to an improved assembly and mounting arrangement.

2. Description of the Prior Art:

Active or passive transducer arrays carried by surface or sub-surface vessels are utilized for detection of distant targets.

The arrays are made up of a multitude of transducer elements, each operable to provide an output signal in response to impingement of acoustic energy within the design frequency range of the element.

Beamformer apparatus carried by the vessel is responsive to all of the transducer element outputs to form one or more beams to obtain an indication of target bearing. In the case of an active system, target range may also be obtained.

In one type of passive system currently in use, a plurality of transducer elements are longitudinally arranged and embedded in a somewhat flexible elongated enclosure called a "biscuit" made of durable nitrile rubber. The individual transducer elements are positioned within individual cavities within the nitrile rubber and potted in place by means of, for example, polyurethane.

A backing means including a signal conditioning plate is mounted on, and generally conforms to the contour of, the carrying vessel below the water line thereof. A plurality of transducer carrying biscuits are, in turn, mounted relatively close to one another in side-by-side relationship on the signal conditioning plate to form the array.

In order to maintain exact positional relationships of the transducer elements, the biscuits are firmly bolted to the signal conditioning plate. In addition, in order to exclude the surrounding water medium form contacting the rear surface of the biscuits, they are also bonded to the signal conditioning plate such as with epoxy and the gaps between biscuits are filled in or sealed with a gap filler.

After the biscuits are bonded in place, there is no convenient way of inspecting the uniformity of the signal conitioning plate to biscuit joint. Any air gaps that might be present may seriously impair the proper operation of the array and, accordingly, the biscuit may have to be removed and re-bonded. In addition, if one or more transducer elements of the biscuit should have to be replaced, the entire biscuit must be removed.

The removal and subsequent replacement of a biscuit is an extremely time-consuming, labor-intensive and costly operation. To initiate a repair or replacement, the entire vessel must be placed in dry-dock or alternatively, the entire array must be removed necessitating the use of a large, heavy-duty crane since the entire array may weight many tons.

To remove an individual biscuit, the gap filler between it and adjacent biscuits must be removed. If the filler material is a potting compound, it must be cut away. Thereafter, nuts and bolts are separated and a lifting force is applied to one end of the biscuit so that the epoxy bond may be broken such as with a chisel. If the bolts holding the biscuit are welded to the signal conditioning plate, the task of chiseling is made that more difficult.

After the biscuit is free, any epoxy remaining on the signal conditioning plate must be removed such as by sanding or grinding after which a new coat of paint may have to be applied. After the paint is cured, which may be days, a new biscuit may be retrofitted by bolting and bonding in place and the vessel placed back into service only after the epoxy has cured.

The above labor-intensive process of replacing a biscuit can take a number of days before the vessel could be placed back into service. With the arrangement of the present invention, a defective hydrophone may be replaced in a matter of hours, or even minutes in situ without any requirement for the vessel being placed in dry-dock.

SUMMARY OF THE INVENTION

The transducer array of the present invention includes a backing means with a plurality of adjacent rail members disposed on the backing means. A plurality of stave members are provided with each stave member being operable to carry a plurality of transducer elements. The rail members are constructed and arranged to receive the stave members in sliding engagement for easy removal of the stave member and its associated transducer elements. An acoustically transparent window covers the entire assembly of rail staves and transducers.

The array may be mounted on a surface or subsurface vessel with appropriate fairing to provide a profile that enables the hydrodynamic flow to pass over the array assembly in a manner that minimizes array self noise. The design is free-flooding such that the surrounding ambient water medium is in contact with the transducer elements behind the acoustic window.

DESCRIPTION OF THE PREFERRED EMBODIMENT

Figure 1:
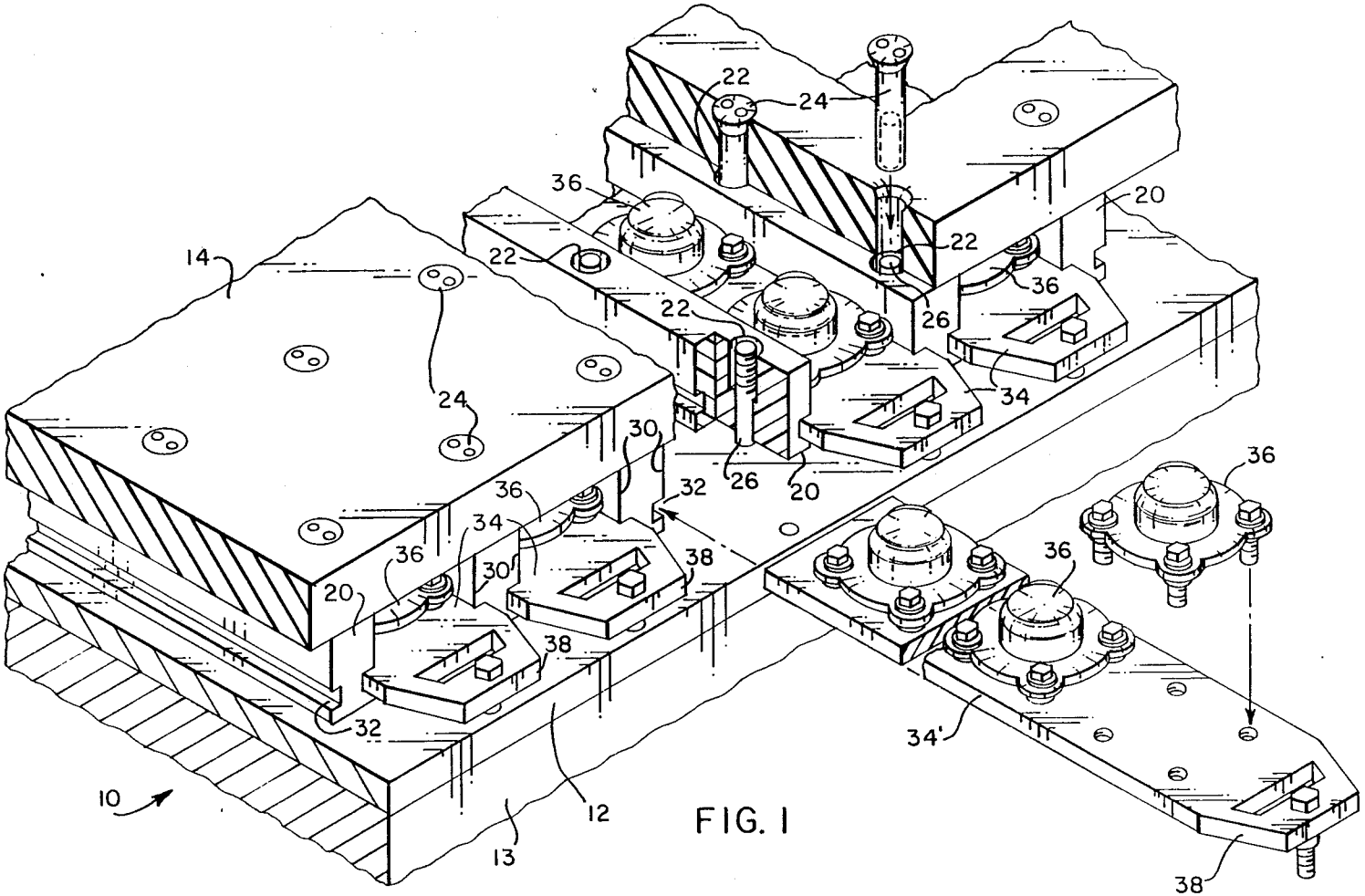
FIG. 1 is a view with portions broken away, of one embodiment of the present invention.

In one embodiment of the present invention, as illustrated in FIG. 1, the array has a backing means 10 which may include, in a well-known manner, a signal conditioning plate 12 to provide signal enhancement for the transducers, and an inner decoupler 13 to isolate the array from evanescent, hull-radiated noise. An outer decoupler 14 is also provided and functions as an acoustic window for the transducers. The outer decoupler or acoustic window 14 is made of a material which has proven stability in a salt water/oily environment and which is acoustically transparent, nitrile rubber being one example.

The signal conditioning plate 12 carries a number of elongated adjacent parallel rail members 20 which support the acoustic window 14. The components may be secured together such as by studs 26 welded to the signal conditioning plate 12 and passing through apertures 22 in rail members 20 and secured in place by means of a tube nut 24. For clarity, only one such stud 26 is illustrated.

The rail members have sidewall portions 30, each including a groove or notch 32 which runs the entire length of the rail member. The array includes a plurality of stave members 34, each adapted to carry a plurality of transducer elements 36. The rail members are constructed and arranged to accommodate the stave members in sliding arrangement for easy insertion and removal. More particularly, in the embodiment illustrated in FIG. 1, each stave member is of a width such as to engage facing notches 32 of adjacent rails 20 in complementary tongue and groove mating. In FIG. 1, four stave members 34 are illustrated as being in the inserted position while one stave member 34' is shown as being removed from its sliding engagement. The insertion and removal of a stave member with its associated transducer is a relatively simple task and to assist in the operation, the ends of each stave member may include a handle 38 which, in the embodiment of FIG. 1, is an integral portion of the stave member itself.

Figure 2:
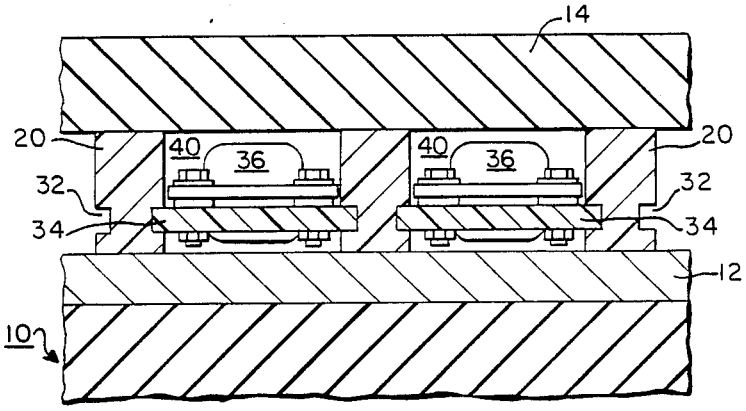
FIG. 2 is an end view of a section of the array of FIG. 1.

As seen in the end view of FIG. 2, the rail members 20 in conjunction with the signal conditioning plate 12 and acoustic window 14 form a plurality of chambers 40 into which the stave members 34 and associated transducers 36 are inserted. During normal operation, chambers 40 are in fluid communication with the surrounding ambient water medium so that the sea water surrounds each individual transducer element as opposed to the prior art arrangement wherein each transducer is encapsulated and subject to shear forces transmitted through the encapsulation material.

Figure 3:
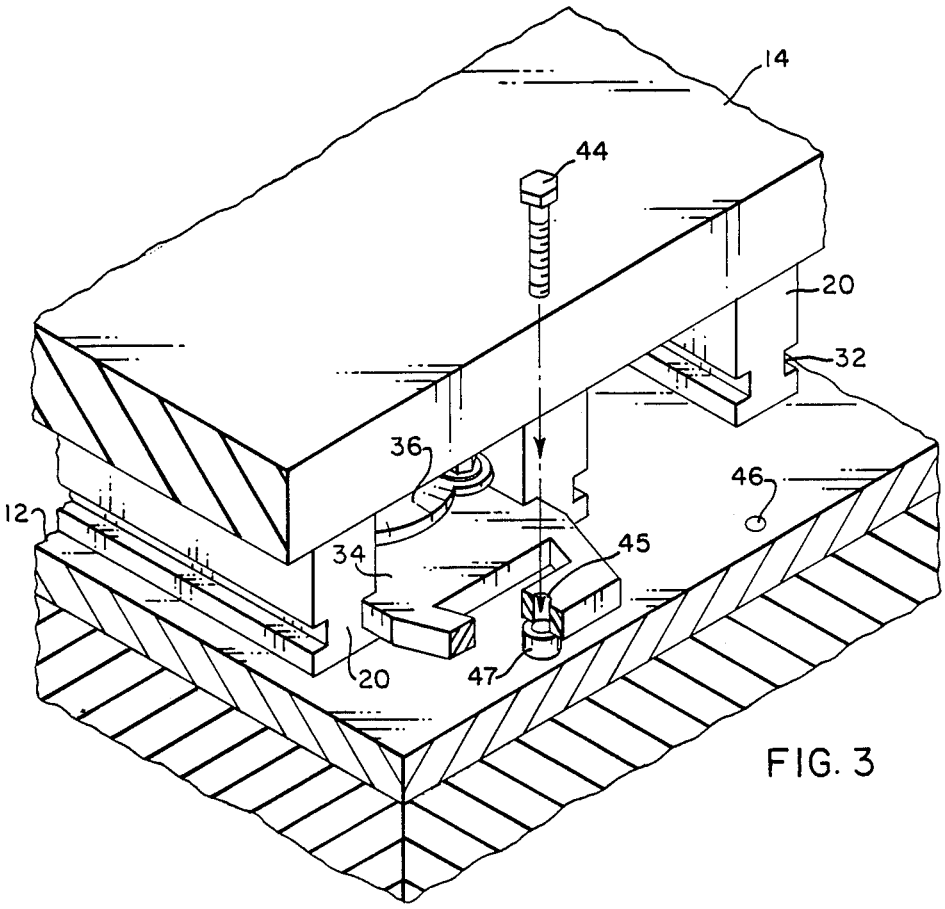
FIG. 3 is a view of a restraining means for a stave member of the array.

With the stave member inserted in the notches of adjacent rail members, forward and lateral movement of the stave member and its associated transducer elements is restrained. It is also desirable to restrain longitudinal movement of the stave member and, accordingly, means are provided to accomplish this task. Any number of restraints may be utilized and FIG. 3 shows one simple method which includes a bolt 44 which passes through an aperture 45 in the end of stave member 34 and is secured by threaded aperture 46 in the signal conditioning plate 12. A spacer 47 is disposed between the underside of stave member 34 and the top surface of signal conditioning plate 12.

Figure 4A:
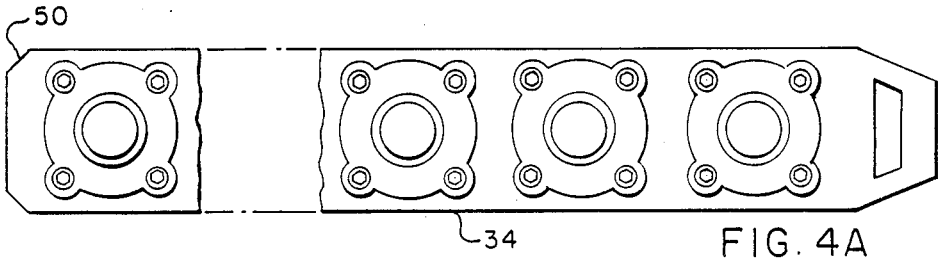
FIGS. 4A and 4B illustrate two end treatments for a stave member.
Figure 4B:
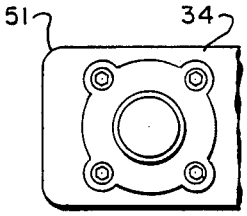

Depending upon the overall dimensions of the array, each rail member 20 may be fabricated from a single length of material or may be made up in sections in end-to-end relationship. In order to prevent the edge of a stave member from snagging at a joint during insertion, the corners of the stave member may be modified as illustrated in FIGS. 4A and 4B. In FIG. 4A, stave member 34 has its corners beveled as at 50 whereas in FIG. 4B, the corners are rounded as at 51.

Figure 5:
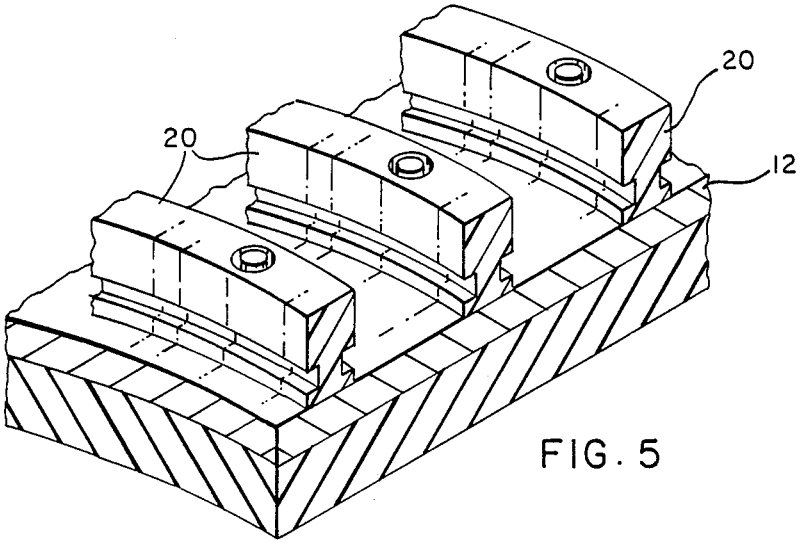
FIG. 5 illustrates rail members on a curved backing.
Figure 6:
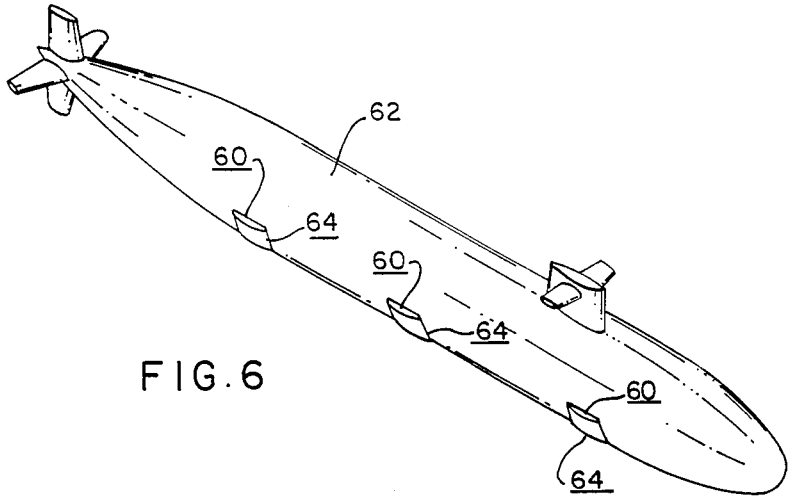
FIG. 6 illustrates the arrays mounted on a submarine.

For use in conjunction with a surface or subsurface vessel, the backing means for the array would be fabricated to have a curvature closely matching that of the carrying vessel. FIG. 5 illustrates a curved signal conditioning plate 12 carrying a plurality of rail members 20 which, depending upon length, material and curvature, could be a straight rail member bent to conform to the curvature or, atlernatively, machined to conform to the curvature. The curved array would be mounted on the side of a vessel such as illustrated in FIG. 6 wherein a plurality of arrays 60 is ilustrated on the outer hull of a submarine 62. The array 60 is contained in a fairing 64 which provides for a desired hydrodynamic flow over the array and is further illustrated in FIG. 7.

Figure 7:
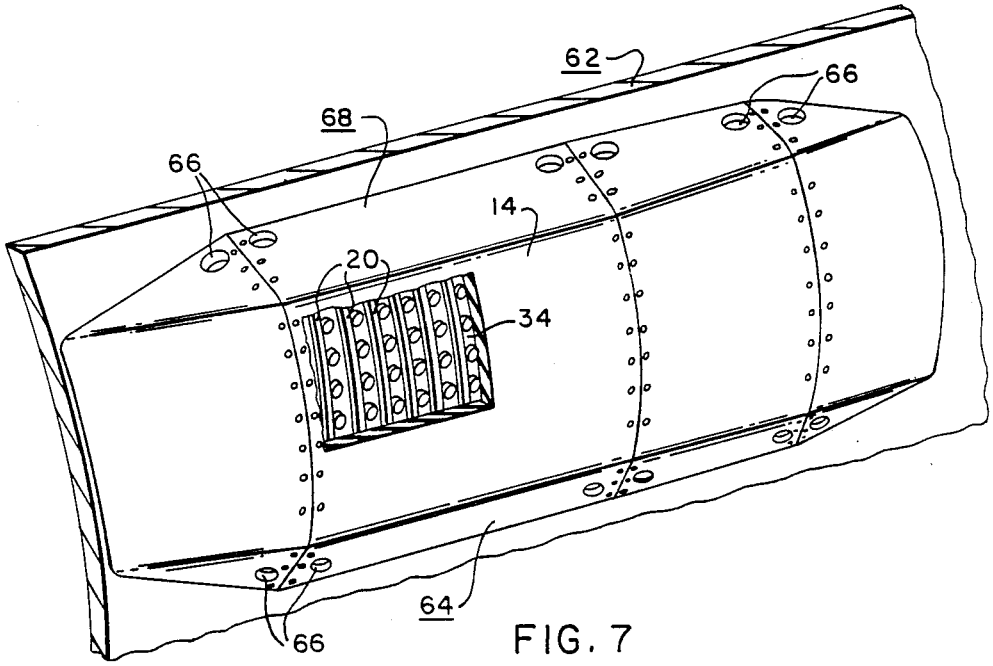
FIG. 7 is a view, with a portion broken away, of an array of FIG. 6.

The acoustic window or outer decoupler 14 is illustrated in FIG. 7 with a portion broken away to illustrate the vertical orientation of the transducer carrying slidable stave members 34 carried by rail members 20. Fairing structure 64 abuts the four edges of the acoustic window 14 and provides a smooth transition to the submarine hull. The fairing includes a plurality of apertures 66 open to the water environment so that the transducer array may be free flooded. One section of the fairing, section 68, is easily removable so that a diver may gain access to any of the slidable staves for easy removal and replacement thereof.

Figure 8A:
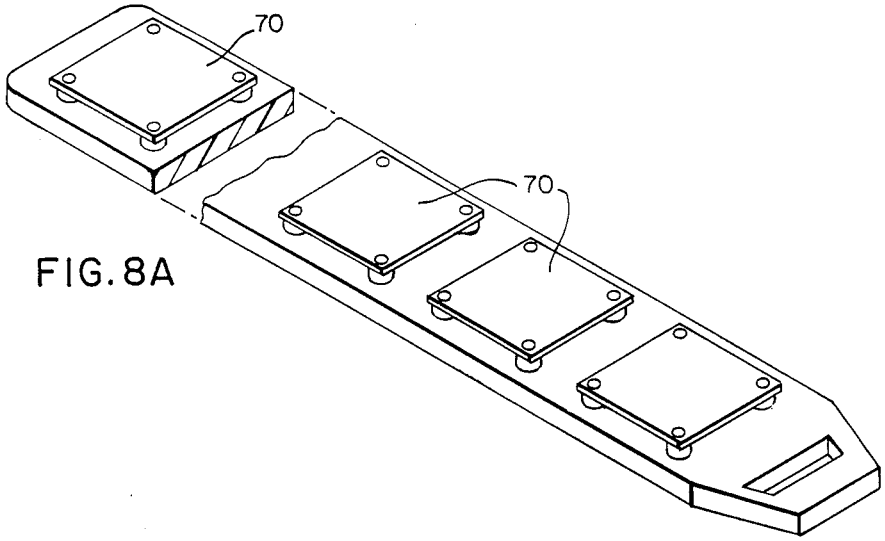
FIGS. 8A and 8B illustrate various transducer elements.
Figure 8B:
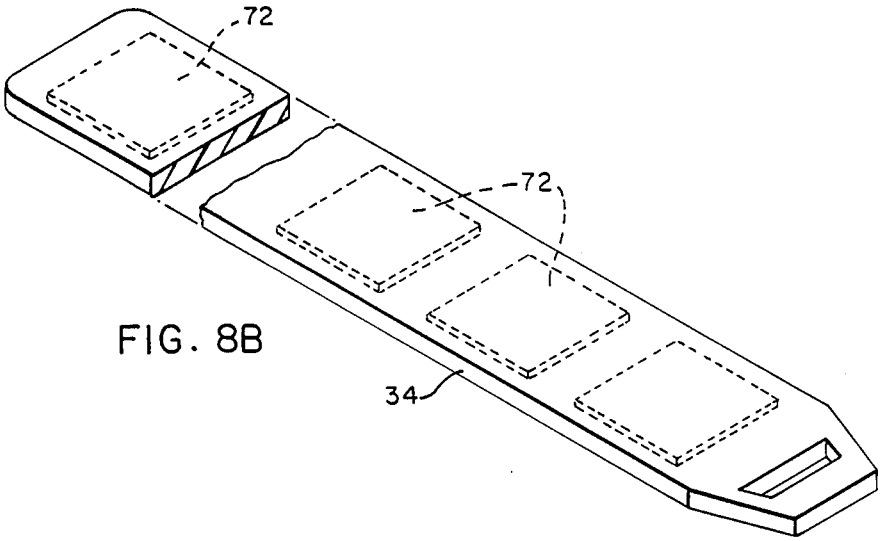

The stave elements can accommodate any one of a variety of transducers and FIG. 8A illustrates a plurality of flat transducers 70 affixed to the top surface of stave member 34. As a variation, FIG. 8B illustrates a plurality of flat transducers 72 which are embedded in the stave member itself. Although not illustrated, the stave elements described herein may also carry one or more transducer signal processing circuits such as preamplifiers.

Figure 9:
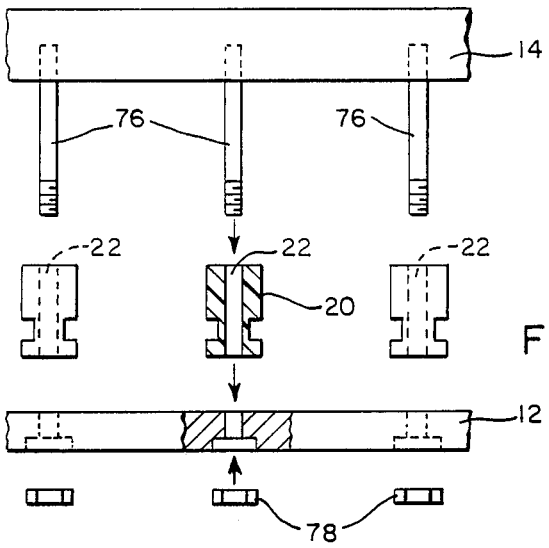
FIGS. 9 and 10 are views of acoustic window variations.
Figure 10:
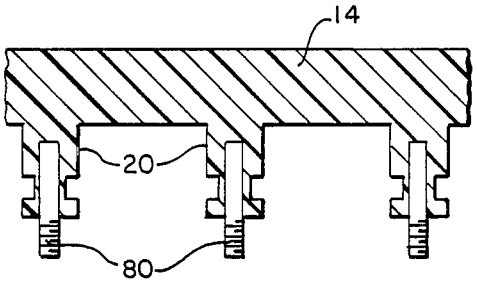

In the embodiment of FIG. 1, the acoustic window 14 is illustrated as being secured by means of tube nuts 24, the heads of which are flush with the surface of the acoustic window. FIG. 9 illustrates an embodiment which eliminates the apertures through the acoustic window such that the outer surface thereof presents a smooth continuous surface. In this embodiment, studs 76 penetrate into and are fastened to the acoustic window 14 and are arranged to pass through the apertures 22 of rail members 20 to be fastened on the other side of signal conditioning plate 12 by means of respective nuts 78. The elimination of through holes in the acoustic window 14 is also accomplished with the embodiment illustrated in FIG. 10 wherein the rail members 20 and the acoustic window 14 are fabricated as a unitary integral piece with studs 80 projecting from rail members 20 for connection to a signal conditioning plate.

Accordingly, there has been described an improved transducer array which may be fabricated of material which have been proven dependable and long-lasting in a sea water environment. The design lends itself to a variety of different acoustic windows as well as a multitude of different transducer element types for either passive or active use. The design is such as to greatly simplify the replacement of one or more hydrophones with the replacement being accomplished in the water environment in a matter of hours or minutes as compared to previous systems wherein a replacement would require days or even weeks.

What is claimed is:

1. A transducer array comprising:

(A) backing means;

(B) a plurality of elongated adjacent rail members disposed on said backing means, each including a top and sidewall portions;

(C) a plurality of stave members each carrying a plurality of transducer elements;

(D) said sidewall portions of adjacent rail members including means for holding a said stave member in sliding engagement for easy removal of said stave member and its associated transducer elements.

2. Apparatus according to claim 1 wherein:
(A) said means for holding in conjunction with said stave member form a complementary tongue-and-groove mating.

3. Apparatus according to claim 2 wherein:
(A) said rail members include said groove in said sidewall potions thereof, with the grooves of adjacent rail members facing one another.

4. Apparatus according to claim 1 wherein:
(A) said backing means is curved; and
(B) said rail members match the curvature of said backing means.

5. Apparatus according to claim 1 wherein:
(A) said rail members are parallel to one another.

6. Apparatus according to claim 1 which includes:
(A) an acoustically transparent window member contacting and covering said top portions of said rail members.

7. Apparatus according to claim 6 wherein:
(A) said window member is integral with a plurality of said rail members.

8. Apparatus according to claim 1 wherein:
(A) each said elongated rail member is of a continuous single piece construction.

9. Apparatus according to claim 1 wherein:
(A) each said stave member includes beveled corners at one end thereof.

10. Apparatus according to claim 1 wherein:
(A) each said stave member includes rounded corners at one end thereof.

11. Apparatus according to claim 1 wherein:
(A) each said stave member includes a handle means at one end thereof for facilitating said removal.

12. Apparatus according to claim 11 wherein:
(A) said handle means is an integral portion of said stave member.

13. Apparatus according to claim 1 which includes:
(A) restraining means for preventing longitudinal movement of a stave member when engaged in said means for holding.

14. A transducer array comprising:
(A) backing means;
(B) an acoustic window member;
(C) a plurality of adjacent elongated wall members extending between and contacting said backing means and acoustic window member so as to define a plurality of elongated open-ended chambers;
(D) a plurality of elongated transducer elementcarrying members positioned within respective ones of said chambers and slideable into and out of said chambers, and
(E) means for restraining forward and lateral movement of said transducer element-carrying member when within a respective chamber.

15. Apparatus according to claim 14 which includes:
(A) means for additionally restraining longitudinal movement of said transducer element-carrying member.

16. Apparatus according to claim 14 wherein:
(A) each said wall member includes a groove in the side thereof extending in the longitudinal direction of said wall member such that adjacent wall members have facing grooves;
(B) each said transducer element-carrying member is a stave which is slideable into said facing grooves.

17. A transducer array comprising:
(A) an elongated stave member;
(B) a plurality of transducer elements carried by said stave member;
(C) rail means constructed and arranged to receive said stave member in sliding engagement and to restrain movement of said stave member in at least two directions, once engaged.

18. Apparatus according to claim 17 which includes:
(A) means to additionally restrain movement of said stave member in a third direction.

* * * * *